US005384530A

United States Patent [19]

Pflueger

[11] Patent Number: 5,384,530

[45] Date of Patent: Jan. 24, 1995

[54] BOOTSTRAP VOLTAGE REFERENCE CIRCUIT UTILIZING AN N-TYPE NEGATIVE RESISTANCE DEVICE

[75] Inventor: Randall J. Pflueger, Cambridge, Mass.

[73] Assignee: Massachusetts Institute of Technology, Cambridge, Mass.

[21] Appl. No.: 926,571

[22] Filed: Aug. 6, 1992

[51] Int. Cl.[6] ..... G05F 1/575; G05F 3/16

[52] U.S. Cl. ..... 323/313; 323/316; 330/104

[58] Field of Search ..... 323/312, 313, 314, 315, 323/316, 280; 330/103, 104

[56] References Cited

U.S. PATENT DOCUMENTS

| | | | |
|---|---|---|---|
| 3,566,088 | 2/1971 | Crook | 235/181 |
| 3,634,751 | 1/1972 | Miller | 323/313 |
| 3,961,274 | 6/1976 | Jones et al. | 328/165 |
| 4,065,682 | 12/1977 | Evans | 307/261 |
| 4,110,677 | 8/1978 | Boronkay et al. | 323/19 |
| 4,242,595 | 12/1980 | Lehovec | 307/205 |
| 4,320,351 | 3/1982 | Brown, Jr. et al. . | |
| 4,384,217 | 5/1983 | Tsividis | 307/297 |
| 4,825,145 | 4/1989 | Tanaka et al. . | |
| 4,849,708 | 7/1989 | Brehmer et al. | 330/110 |
| 4,851,759 | 7/1989 | Blauschild | 323/223 |
| 5,047,661 | 9/1991 | Berndt et al. | 307/296.6 |
| 5,097,198 | 3/1992 | Holmdahl . | |
| 5,099,191 | 3/1992 | Galler et al. | 323/313 |
| 5,126,846 | 6/1992 | Niimura | 358/167 |
| 5,140,188 | 8/1992 | Burns | 307/362 |
| 5,180,932 | 1/1993 | Bengel | 307/353 |

FOREIGN PATENT DOCUMENTS

| | | |
|---|---|---|
| 0361379 | 4/1990 | European Pat. Off. . . |
| 1186556 | 2/1965 | Germany . |

OTHER PUBLICATIONS

*Electronics International*, "Negative Resistance Shown in Dual FET Device", vol. 47, No. 8, Apr. 18, 1974, pp. 5E–6E.

*1990 IEEE International Symposium on Circuits and Systems*, vol. 3 of 4, New Orleans, May 1, 1990, pp. 1731–1735.

Smilen et al., "Stability Criteria for Tunnel Diodes," *I.R.E. Proceedings*, 49:1206–1207, Jul. 1961.

Smilen et al., "On the Stability of Tunnel Diodes," Technical report, Polytechnic Institute of Brooklyn, Microwave Research Institute, Networks and Waveguide Group, 30 Jan. 1962, Memorandum 49:PIBMRI-899-61.

*Primary Examiner*—Steven L. Stephan
*Assistant Examiner*—Adolf Berhane
*Attorney, Agent, or Firm*—Samuels, Gauthier & Stevens

[57] ABSTRACT

A bootstrap voltage reference circuit having an amplifier with a positive feedback network including a non-linear device which operates as a current source. The non-linear device may be an n-type negative resistance device such as a tunnel diode. The circuit is operable for generating a predetermined reference voltage as the difference between the signal applied to the positive input and a signal generated by the negative feedback network and applied to the negative input approaches zero.

40 Claims, 5 Drawing Sheets

FIG. 5

| | CAPACITIVE SHUNTING | RC SHUNTING | dc AND RC SHUNTING |
|---|---|---|---|
| Vp (V) | 0.0697 | 0.0697 | 0.0697 |
| Ip (A) | 0.0102 | 0.0102 | 0.0102 |
| V (Rj = 1000 Ω) (V) | 0.070 | 0.070 | 0.070 |
| I (Rj = 1000 Ω) (A) | 0.010 | 0.010 | 0.010 |
| S (mho/volt) | 3.0 | 3.0 | 3.0 |
| $I_F / I_V$ | 8 | 8 | 8 |
| $R_1$ (Ω) | 990.8 | 990.8 | 983.70293 |
| $R_2$ (Ω) | 9.2 | 9.2 | 9.2144 |
| $R_3$ (Ω) | 990.8 | 990.8 | 990.7856 |
| A | $1.0 \times 10^{1}$ | $1.0 \times 10^{1}$ | $1.0 \times 10^{1}$ |
| r (sec) | 0.159 | 0.159 | 0.159 |
| Cj (F) | $5.7 \times 10^{-12}$ | $5.7 \times 10^{-12}$ | $5.7 \times 10^{-12}$ |
| Rj (Ω) | 1000.0 | 1000.0 | 1000.0 |
| $R_s$ (Ω) | 0.2 | 0.2 | 0.2 |
| $L_s$ (H) | $1.0 \times 10^{-9}$ | $1.0 \times 10^{-9}$ | $1.0 \times 10^{-9}$ |
| Rser (Ω) | 2.0 | 2.0 | 2.0 |
| Csh1 (F) | $1.0 \times 10^{-11}$ | $1.0 \times 10^{-11}$ | $1.0 \times 10^{-11}$ |
| Rsh1 (Ω) | 0.0 | 10.0 | 10.0 |
| Rsh2 (Ω) | ∞ | ∞ | 1000.0 |

BOOTSTRAP VOLTAGE REFERENCE CIRCUIT UTILIZING AN N-TYPE NEGATIVE RESISTANCE DEVICE

BACKGROUND OF THE INVENTION

The invention relates to a bootstrap voltage reference circuit which utilizes an n-type negative resistance device.

Two types of n-type negative resistance devices (NNRD) have been tested for use in voltage reference circuits. The p-n junction tunnel diode (TD) and the resonant tunneling diode (RTD). Each of these devices has a local maximum in their respective I-V characteristics which can in principle be used in two ways to develop a reference signal. As a current source using a fixed bias voltage and as a voltage source, by referencing the position of the peak voltage.

The use of n-type negative resistance (NNRD) devices for precision reference sources was initially introduced in U.S. Pat. No. 5,099,191 issued to Galler et al., and incorporated herein by reference. The technique is illustrated in FIG. 1, where an I-V curve 10 for an NNRD (in the illustrated case a p-n junction tunnel diode) is shown biased at slightly to the right of the current peak 12, at an operating point 14 where the DC dynamic resistance ($R_{dyn}$) of the matched device is large in magnitude (perhaps $10^3$ ohms or more) and negative in sign. Given a bias voltage of modest stability, the fluctuations in the current can be made arbitrarily small by choosing the operating point to be closer to the peak, where $R_{dyn}$ approaches $\infty$ and the slope 16 of the I-V curve approaches zero. By exploiting the relative immunity of the current to fluctuations in bias voltage, and converting the current to a voltage, a stable reference is obtained.

SUMMARY OF THE INVENTION

In accordance with the present invention, a bootstrap voltage reference circuit is provided. The circuit includes an amplifying comparator device such as an operational amplifier having first and second inputs and an output, the amplifying comparator device operable for generating a predetermined reference voltage as the difference between a first signal applied to the first input and a second signal applied to the second input approaches zero. A positive feedback network is coupled between the output and the first input of the amplifying comparator device, the positive feedback network including a non-linear device which operates as a current source, and generating the first signal applied to the first input. A negative feedback network is coupled between the output and the second input of the amplifying comparator device, the negative feedback network generating the second signal applied to the second input.

BRIEF DESCRIPTION OF THE DRAWINGS

FIG. 5 shows a table with an exemplary list of nominal values for elements illustrated in FIG. 4.

DETAILED DESCRIPTION OF THE ILLUSTRATED EMBODIMENTS

Figure 2A:
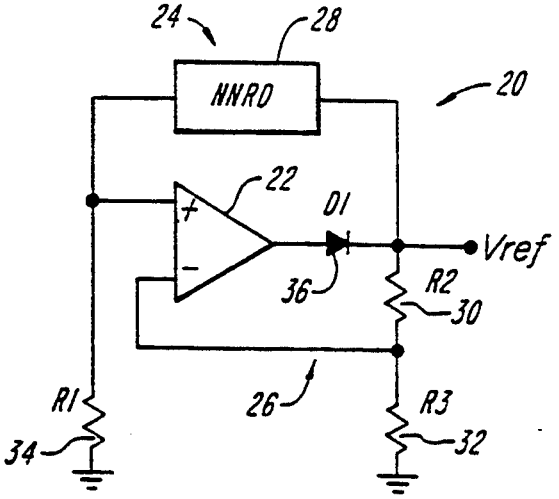
FIG. 2A and 2B show schematic block diagrams of alternate embodiments of a bootstrap voltage reference circuit in accordance with the present invention.

With reference now to FIG. 2A, a bootstrap voltage reference circuit 20 according to the present invention is shown. The circuit includes an operational amplifier (op-amp) 22 having positive feedback network elements 24 coupled to a positive or non-inverting input, and a negative feedback network 26 coupled to a negative or inverting input. The illustrated embodiment utilizes an n-type negative resistance device 28, for example a tunnel diode, in the positive feedback network, and a resistor divider with resistors 30 and 32 in the negative feedback network. A trimming resistor 34 coupled to the positive input and a forward biased diode 36 coupled to the output of the op-amp are also utilized. The circuit 20 is operable for biasing the NNRD 28 at a desired operating point $\{I_{ref}, V_{ref}\}$ and converting the current developed by the NNRD 28 to a reference voltage $V_{ref}$ at the output of the op-amp. An alternate embodiment of the circuit 20 is shown in FIG. 2B, wherein additional shunt resistors 38 and 39 are added to the input of the op-amp 22 in order to develop the reference signal $V_{ref2}$ from the positive input of the op-amp, yielding relative insensitivity to input offset voltages at the expense of a higher output resistance.

Figure 2B:
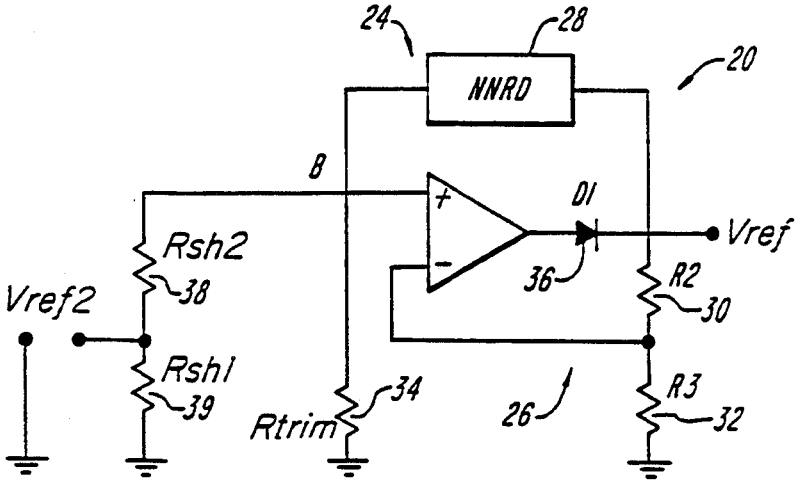

The bootstrap voltage reference circuit 20 of the type illustrated in FIGS. 2A and 2B, functions by developing a difference signal between the positive 24 and negative 26 feedback networks which converges to a stable small value at a single value of the output signal which biases those networks. The bootstrap circuit 20 operates by feeding back to the op-amp 22 input a signal proportional to the difference in current of the NNRD and a resistor of value $(-R_1R_2/R_3)$ as each is biased by the voltage which varies with $V_{out}$. As the difference between the positive and negative inputs of the op-amp approaches zero, the op-amp is stabilized at its designed operating point, thus yielding the predetermined reference voltage $V_{ref}$.

The following criteria must be satisfied in order to obtain stable operation at a non-zero value of $V_{out}$: (1) the circuit is unstable at $V_{out}=0$; (2) there are no stable operating points accessible for $V_{out}<0$; (3) $V_{out}$ is stable at $V_{out}=V_{ref}$.

The circuit of FIG. 2A is shown to satisfy each of these conditions. While the illustrative embodiments utilize an NNRD such as a tunnel diode, it will be appreciated by those of skill in the art that other devices which operate as a current source may be used in the positive feedback network 24 of the circuit 20. For example, any non-linear device which operates as a current source $[\partial I/\partial V \approx 0]$ over some region or at least one point on the I-V curve associated with the non-linear device where at least one such point does not occur at $V=0$. Specific examples of other devices which may be used include resonant tunnel diodes and back diodes.

With regard to criterion (1), it will be appreciated by those of skill in the art that for $V_{out}$ increasing from zero volts, the difference signal to the op-amp 22 is positive, which reinforces the perturbation. Similarly, for $V_{out}$ decreasing, the difference signal is negative, again damping the perturbation. Since for $V_{out}=0$ any perturbation drives $V_{out}$ far from zero, the circuit is not stable at this output voltage.

The criterion (2) is clearly satisfied in the case of a tunnel diode network being differenced with a resistor network, since the difference signal has no zero solution for negative values of $V_{out}$. However, if the NNRD is a resonant tunnel diode, then for certain devices there will be two stable solutions for $V_{out}$. Resonant tunnel diodes are not necessarily completely symmetric, for instance those designed for reference use would likely be asymmetric due to incorporation of parasitic elements for compensation of radiation and temperature compensation. To guarantee that only the design polarity is accessible, the diode 36 is placed at the output of the op-amp 22, thereby preventing the op-amp from sinking more than the reverse leakage current of the diode. In this case $V_{out}$ is driven back to zero since the impedance of the diode 36 is greater than that of the resistor network, resulting in feedback which acts to damp the negative perturbation.

Turning now to criterion (3), convergence to the design operating point is guaranteed by the sign of the feedback difference at points above and below the operating point. For the circuit of FIG. 2A and with reference to the I-V curve of FIG. 1, $V_{out}>V_{ref}$ implies a negative feedback signal 44 (D-C) which reduces $V_{out}$. Similarly, for $V_{out}<V_{ref}$, the feedback difference 46 (A-B) is positive and $V_{out}$ increases.

The illustrated linear network 26 feeding back to the inverting or negative input of the op-amp 22 may be replaced by a non-linear network for which the above four conditions remain true, and a reference signal could still be obtained. The use of a resistive linear network in this capacity is perhaps the easiest configuration for realizing a stable $V_{ref}$ using an NNRD in the positive feedback network. However, if it is desirable to incorporate a specific compensation mechanism, or have multiple reference voltages selectable from the same circuit, then other networks may be utilized. In fact, any linear or non-linear device which operates as a voltage source over at least one point on an I-V curve associated with that device where the at least one point does not occur at $V=0$ may be utilized. For example, non-linear devices such as avalanche diodes or s-type negative resistance devices (one instance being a metal-insulator semiconductor switch diode) may be utilized.

The preferred types of NNRD utilized in the bootstrap voltage reference circuit of the present invention are the p-n junction tunnel diode (TD) and the resonant tunneling diode (RTD). Each of these devices shows a local maximum in the I-V function which can in principle be used in two ways to develop a reference signal: (1) as a current source using a fixed bias voltage, described above, and (2) as a voltage source, by locking on to the position of the peak voltage. The latter yields a poor reference signal in practice, and will not be discussed further. The use of an NNRD as a highly regulated, stable current source is more effective. The TD can be designed with a zero temperature coefficient of the peak current ($I_{peak}$) at any particular temperature between room temperature and 100 degrees centigrade. The TD exhibits an extreme insensitivity to both ionizing and neutron radiation, and can be designed to have a null response point in the neighborhood of $I_{peak}$ up to $10^{17}$ neuts/cm$^2$. At $I_{peak}$, commercially available TDs typically show shifts of 3–5 ppm for fluences of $10^{13}$ neuts/cm$^2$, scaling linearly with fluence to at least $10^{17}$ neuts/cm$^2$. Finally, as will be described hereinafter, the noise current spectral density of a TD-based reference is comparable to that obtained from high quality Zener-based reference producing the same output voltage.

The criteria for selecting the devices for a bootstrap voltage reference will be discussed, and the conditional stability of a particular circuit based upon a TD will be demonstrated for exemplary purposes only. The constraints developed can be generalized to any NNRD, but the specific instances discussed hereinafter apply only to TDs.

Figure 3:
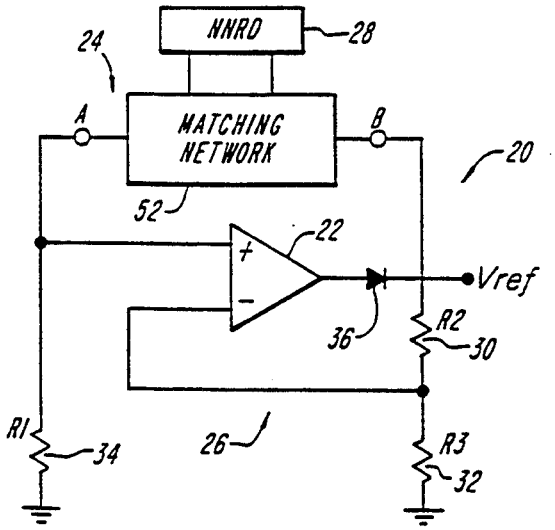
FIG. 3 shows a schematic block diagram of the bootstrap voltage reference circuit of FIG. 2A including a matching network.
Figure 4:
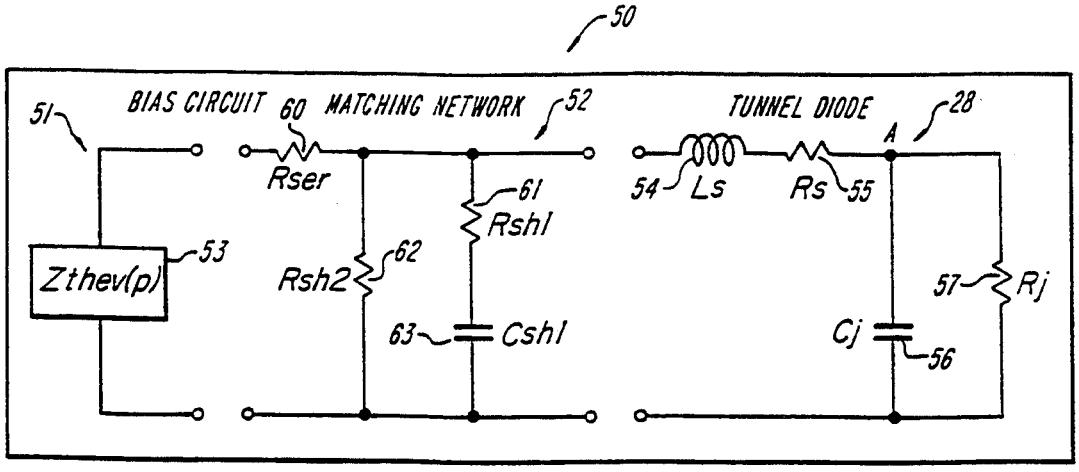
FIG. 4 shows a small signal model diagram of the bootstrap voltage reference circuit with an exemplary matching network of FIG. 3.

With reference now to FIGS. 3 and 4, the bootstrap reference voltage circuit 20 with a matching network 52 and a small signal model 50 for the bootstrap circuit 20 of FIG. 2A are respectively shown. The small signal model 50 includes a bias circuit 51, the matching network 52, and the NNRD 28 (tunnel diode). The feedback resistors 30,32,34 and op-amp 22 are compiled into a Thévenin equivalent impedance $Z_{Thé_v}(p)$ (where p is the complex frequency $\delta+i\omega$) at 53. The tunnel diode includes a series inductance 54, a series resistance 55, a capacitance 56, and a negative resistance 57. The matching network includes a series resistance 60, shunt resistances 61 and 62, and a shunt capacitance 63.

The table of FIG. 5 provides an exemplary list of nominal values for the TD parameters and circuit elements. The origin of these values will be described hereinafter. Subsequent calculations demonstrate the stability (to electrical oscillation) of this combination of circuit elements (and small variations of same). The nominal values are provided for each of the components in the circuit illustrated in FIGS. 2A and 4. The properties of a specific NNRD, a p-n junction tunnel diode, along with realistic values for the components of the matching network, are contained in FIG. 5. These values, or small variations around these values, are used in subsequent demonstrations of the stability of particular bootstrap reference circuits.

Design of a voltage reference circuit proceeds by specifying the ambient conditions experienced by the device and the surrounding circuitry, and the precision to be maintained by the reference signal. The total acceptable error is then partitioned between the NNRD and the balance of the reference circuit. Assuming this has been done, the next step is to decide on components for the balance of the bootstrap circuit which: (1) have compatible or compensatory environmental sensitivities; (2) force the matched NNRD to operate at the design dc operating point ($I_{opt}$, $V_{opt}$) where $I_{opt}$ and $V_{opt}$ specify the matching network terminal voltage and current at which optimum performance is achieved; and (3) results in a circuit stable against oscillation.

Criterion (1) refers to, for example, the selection of a series resistance for the tunnel diode which has a neutron coefficient of a magnitude which helps to achieve a more stable null response point than that obtained from the interplay of band-band and excess currents alone. Alternatively, compensation techniques to mitigate environmental fluctuations can be implemented in the external circuitry as well. Criteria (2) and (3), selection of components to realize the desired DC and AC operation, are considered below.

It will be appreciated by those skilled in the art that fabrication of the bootstrap circuit according to the present invention will take into account parasitic elements which will not be discussed in detail. With reference to the properties of the TD which are summarized in FIG. 5, the value of V and I at the TD terminals such that $R_j=1000\Omega$ are taken to be 70 mV and 10 mA, respectively. These operating point properties are chosen, in the absence of data on a particular device as nominal and mutually consistent values which could be easily realized in TDs.

The values for circuit elements are the result of calculations to determine what can be achieved by conventional TD fabrication techniques. The absence of inductance from the matching network is the result of calculation of the self-inductance of "flat" metal leads on an insulating substrate. It is possible to achieve inductances of less than 0.0001 nH for runs of 100 μm. With careful design techniques, the parasitic inductance between the TD and the op-amp input should be well below 0.01 nH. This is too small to contribute to the instability of the sample TD, since the associated pole frequencies are above the TD resistive cutoff frequency.

As described above, FIG. 4 shows the Thévenin equivalent resistance 53 of the bootstrap circuit 20 coupled to a matching network 52 and to an NNRD, in the illustrated embodiment a tunnel diode 28 (small signal equivalent, biased in the negative resistance region). The dc operating point of the circuit is determined from a knowledge of the junction design operating point and dynamic resistance ($R_s$-$R_j$) at 55 and 57, the series resistance 60 up to the connection with the bootstrap circuit ($R_{ser}$), and the magnitude of the dc shunt resistor 62 in the matching network ($R_{sh2}$). $R_s$ is the series resistance of the TD up to connection with the matching network, and $R_j$ is the magnitude of the junction dynamic resistance.

Figure 6:
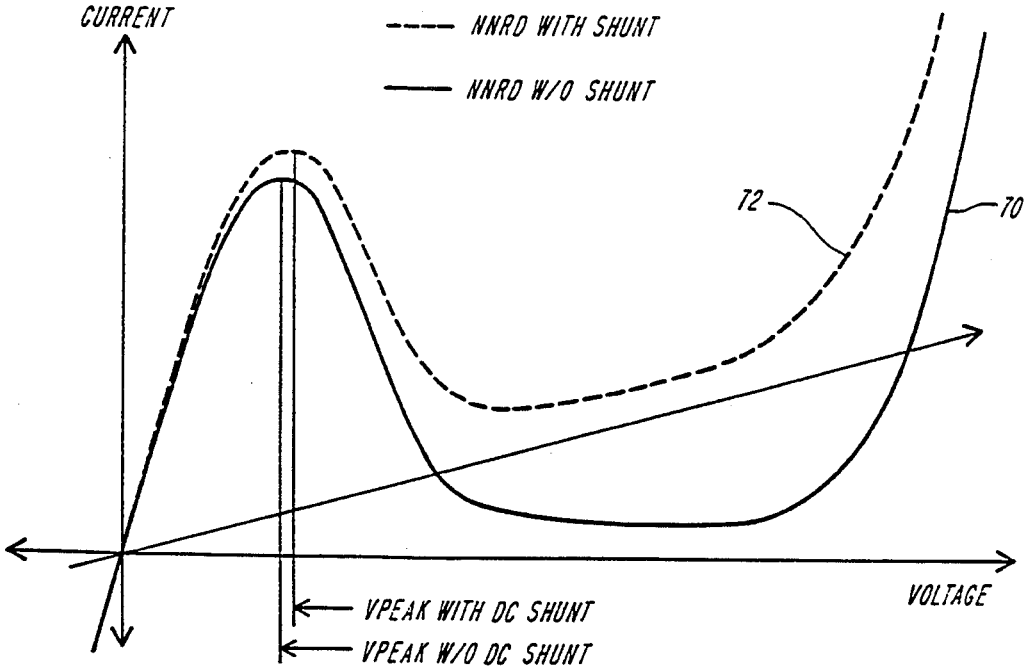
FIG. 6 shows an I-V curve of a tunnel diode NNRD illustrating the effects of a dc shunt used in the bootstrap voltage reference matching network.

The incorporation of a pure resistive shunt 62, $R_{sh2}$ in FIG. 4, provides a means of selecting an optimum NNRD operating point independently of the current regulation, perhaps based upon the requirement of achieving a null in the neutron response to a high fluence, or to move the operating point further into the negative resistance region, where the current regulation is improved (to second order) due to a smaller curvature of the composite I-V curve. The effect of the dc shunt, shown in FIG. 6 with curve 70 representing the NNRD without the dc shunt and curve 72 representing the NNRD with the dc shunt, is to select the voltage at which the dynamic impedance of the composite I-V curve is infinite. The shunt adds a linear I-V function of voltage to the non-linear I-V function of the NNRD. From the relation for combining parallel resistors, $$R_{dyn} = \frac{1}{\left(\frac{1}{R_{sh2}}\right)+\left(\frac{1}{(R_s - R_j)}\right)} \tag{1}$$

it is seen that for, $R_s$-Rj<0, $R_{dyn}$ is infinite at the value of $V_{bias}$ at which $R_{sh2}=|R_s\text{-Rj}|$. $V_{bias}$ is the voltage supplied to the terminals of the matching network, for which $V_{peak}$ is the design value.

Two drawbacks encountered when using a shunt resistor are the increased dc current sourced by the op-amp 22, and the additional heat which is dissipated by the shunt resistor. When biasing the device near the current peak, the magnitude of the negative resistance at the operating point is large, and the current flowing through a shunt resistor of equal magnitude is small relative to $I_j$. However, in the event that the TD is driven at a value of $V_j$, the voltage drop across the tunnel junction, such that $|R_j|$ is small, the use of a dc shunt becomes less attractive due to the large additional current through $R_{sh2}$.

The quality of an NNRD reference depends in part upon the regulation of fluctuations in the signal driving the NNRD. A means of quantifying the stability of the reference current to fluctuations in $V_{bias}$ follows, for the case of open-loop biasing of the NNRD. First, the regulation ratio for an NNRD biased by a voltage source is defined as follows:

$$\Gamma = \frac{\Delta I_{ref}}{I_{ref}} = \frac{(\Delta V_{bias}/R_{dyn})}{I_{ref}} \tag{2}$$

In the bootstrap circuit 20, $R_{dyn}$ is defined as the net resistance of the tunnel diode 28 shunted by $R_{sh2}$ as in equation 1. Additional parameters must be defined to account for the possibility that $R_{sh2}$ is designed to have a magnitude slightly different than $|R_s\text{-}R_j|$, due to satisfaction of other constraints, and for the magnitude of the error in achieving the design value. For example, in a bootstrap circuit optimized for immunity to neutron irradiation, $(V_j+I/R_s)$ will be greater than $V_p$, and the combined matching network and tunnel diode will be biased to have a negative effective $R_{dyn}$. In this case, $R_{sh2}>(R_s\text{-}R_j)=\beta$, and the actual value of $R_{sh2}$ is defined as $$R_{sh2}=(R_s\text{-}R_j)+\delta+\nabla=\beta+\delta+\nabla \tag{3}$$

where δ is the design augmentation to β, and ∇ is the difference (the error) between the design value of $R_{sh2}$ and the actual value. In practice, $0\leqq|\bigstar|<<\delta<\beta$ is expected to obtain.

A final refinement to equation 2 is to define the fractional variation in $V_{bias}$ as $$\gamma = \frac{\Delta V_{bias}}{V_{bias}} \tag{4}$$

Equation 2 can now be rewritten as $$\Gamma = \frac{\Delta I_{ref}}{I_{ref}} \tag{5}$$

$$= \frac{\gamma \cdot V_{bias}}{I_{ref}}\left[-\frac{\delta}{\beta(\beta+\delta)} - \frac{\nu}{(\beta+\delta)(\beta+\delta+\nu)}\right] \tag{6}$$

$$= \left(\frac{\gamma \cdot V_{bias}}{I_{ref}}\right)\left(\frac{1}{\beta+\delta}\right)[-\delta' - \nu'] \tag{7}$$

δ' and ∇' are the fractional deviations of Rsh from Rsh from β and (β+δ) respectively. Equation 5 is used in the following manner. At a candidate operating point ($V_{bias}$, $I_{ref}$, $R_j$, $R_s$) and for particular values of δ and Γ, the maximum value of ∇ for which Γ is below its design value can be determined. For example, for $V_{bias}=0.07$ V, $I_{ref}=0.01$ A, $\delta=1.4\ \Omega$, $R_j=10^3\ \Omega$, $R_s=1\ \Omega$, $\gamma=10^{-3}$, and $\Gamma\leqq10^{-8}$), the maximum permissible value of ∇ is 0.03; Ω. This analysis is correct to first order, but neglects the effect of curvature. The linear analysis must be corrected by considering the effects of curvature of the I-V function of the matched and shunted TD in the region of the current peak, as follows.

The conductance of a germanium TD varies linearly with voltage in the region of the current peak, with a slope of about ~3 mho/Volt. With the germanium tunnel diode in the present example, a dynamic resistance of 1000 Ωis obtained at approximately 1.0043 times the peak voltage. At this bias voltage the dynamic resistance changes with voltage with slope $3.0\times10^6$ Ω/Volt, so that regulation of the bias voltage to one part in $10^4$ induces a shift in dynamic resistance of 21 Ω(to 979 Ω). Continuing this example, by shifting the operating point to $1.0042\times V_{peak}$, then for a variation in $V_{bias}$ of 1 part in $10^4$, $R_{dyn}$ would equal or exceed $10^3$ Ω and the analysis using equations (2)–(7) applies. For an operating point further into the negative differential resistance region (NDR), the curvature is reduced and the requirements for tight regulation are lessened.

For an avalanche diode biased by a current source, the fractional fluctuation in the voltage as a function of fluctuations in the bias current is given by $$\Gamma = \frac{\Delta V_{ref}}{V_{ref}} = \frac{\gamma \cdot I_{bias} \cdot R_{dyn}}{V_{ref}} \tag{8}$$

where y is now defined by $$\gamma = \frac{\Delta I_{bias}}{I_{bias}} \tag{9}$$

For a 6.4 volt temperature compensated diode (consisting of a 5.8 volt zener in series with a forward diode) driven with 2 mA, the a lower bond to the dynamic resistance is approximately 2 Ω. Using these values in equation 8, along with the requirement that $\Gamma \leqq 10^{-8}$, the maximum value of $\gamma$ is found to be $3.2\times10^{-5}$. This is an upper bound on Γ, and is still 3 times smaller than Γ found for a shunted tunnel diode biased arbitrarily (in an open loop configuration) at an operating point where $R_j$ is equal to $10^3$Ω, and with a fractional mismatch between the $R_{sh2}$ and $R_j$ of $1.43\times10^3$. In this case the TD regulation could be further improved by choosing an operating pint with a larger value of the dynamic resistance. No improvement in the regulation of the avalanche diode is possible.

Selection of the feedback resistors in the presence of both RC and dc shunting requires that the extra current through the dc shunt be accounted for in the total current flowing through $R_1$. The value of $R_1$ in the ratio $R_2/R_3$ is found from a knowledge of the TD operating point, through the following relations:

$$R1 = \left( \frac{V_{ref} - (I_j \cdot R_s + V_j)}{\frac{I_j \cdot R_s + V_j}{R_{sh2}} + I_j} \right) - R_{ser} \tag{10}$$

$$\frac{R2}{R3} = \frac{V_{ref}}{R1\left(\frac{I_j R_s + V_j}{R_{sh2}} + I_j\right)} - 1 \tag{11}$$

In equations (10) and (11), $V_{ref}$ is the reference voltage at the output of the circuit of FIG. 2A, and $I_j$ and $V_j$ are the current through and voltage across the tunnel junction, respectively. These apply for the case of pure RC shunting ($R_{sh2}=\infty$), and for the case of purely capacitive shunting ($R_{sh2}=0$). To find the values of $R_2$ and $R_3$ separately, additional information or constraints must be brought to bear. One such constraint is matching of the voltage drops induced by op-amp input currents to maximize common-mode rejection, which requires that $R_1$ and $R_3$ be as closely matched as possible. In the examples of this application, the magnitudes of $R_2$ and $R_3$ were determined by the (arbitrary) requirement that the current through them equal 10 mA.

Using a single pole approximation to the open loop transfer function of the op-amp, $Z_{Thev}[p]$ is the Thévenin equivalent impedance of the op-amp and feedback resistors ($R_1$–$R_3$).

$$Z_{Thev}[p] = V_{test}/I_{test} = R1 \cdot \frac{\left(1 - \frac{A \cdot R2}{(1 + r \cdot p)(R2 + R3)}\right)}{\left(1 + \frac{A \cdot R3}{(1 + r \cdot p)(R2 + R3)}\right)} \tag{12}$$

where p is the complex frequency ($\sigma+i\omega$), and A is the dc open loop gain of amplifier 22. In the dc limit the Thévenin equivalent resistance becomes $$R^{dc}_{Thev} = -\left(\frac{R1 \cdot R2}{R3}\right) \tag{13}$$

Figure 1:
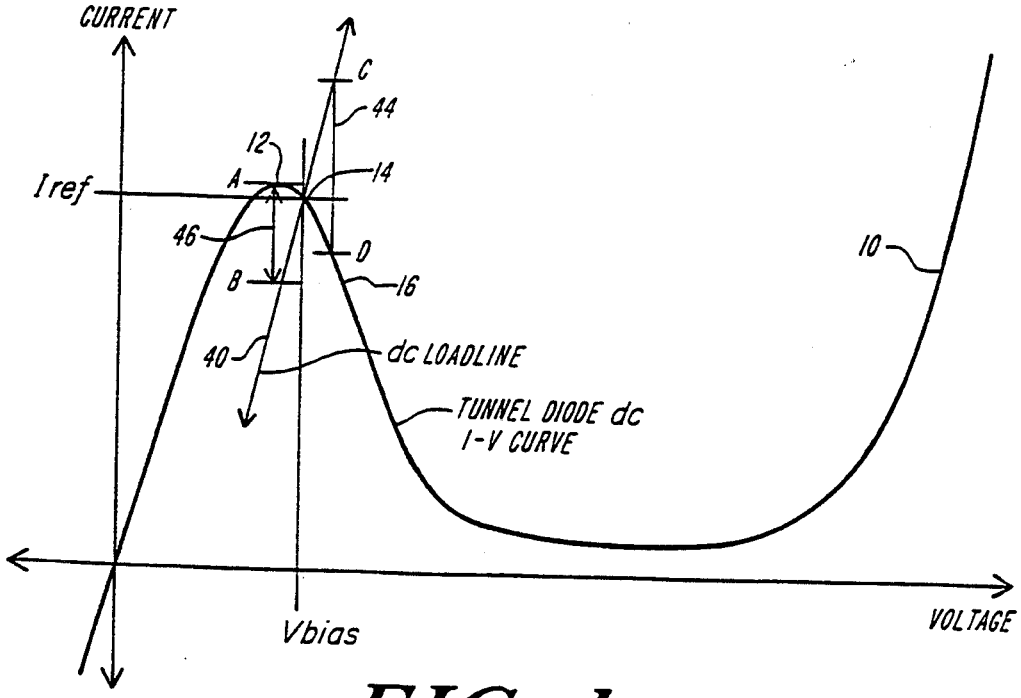
FIG. 1 shows an I-V curve of a p-n junction tunnel diode NNRD with superimposed dc loadlines for a bootstrap voltage reference circuit in accordance with the present invention.

The intersection of the bias circuit loadline with the I-V curve of the NNRD at the operating point $\{V_{ref}, I_{ref}\}$ is shown in FIG. 1 $R^{dc}_{Thev}$ is the inverse of the loadline slope, given by equation 13. For the values of $R_1$, $R_2$, and $R_3$ in column 1 of table 5 $R^{dc}_{Thev}$ is equal to −9.2 Ω.

The reference circuit is stable to oscillation if the poles of the junction driving point impedance are confined to the open left-hand side of the complex p-plane. A theorem on the potential stability of a particular NNRD provides a necessary and sufficient condition for determining whether a passive termination can be found which stabilizes the NNRD. Once passive stabilization of a particular device is demonstrated, the analysis of stability proceeds by calculating the locations of the poles of the TD junction voltage resulting from a 6 function current spike applied at node A in FIG. 4.

A theorem developed by L. I. Smilen and D. C. Youla in "Stability Criteria for Tunnel Diodes," *I.R.E. Proceedings*, 49:1206–1207, July 1961; and "On the Stability of Tunnel Diodes," Technical report, Polytechnic Institute of Brooklyn, Microwave Research Institute, Networks and Waveguide Group, 30 January 1962, Memorandum 49: PIBMRI-899-61, is utilized to demonstrate the possibility for passive stabilization of the prototype TD. FIG. 4 shows the small signal model of a tunnel diode. The parameters are defined as follows: $R_s$ is the sum of the substrate spreading resistance and the ohmic contact resistance, $L_s$ is the total series inductance including the ohmic contacts, $C_j$ is the junction capacitance, $R_j$ is the magnitude of the junction dynamic resistance.

Designating the impedance of the tunnel diode 28 by $Z_d(p)$, and the impedance of the balance of the circuit by $Z_d(p)$, a tunnel diode is said to be potentially stable if there exists at least one passive termination such that for the real positive function Z(p), the equation $$Z(p)+Z_d(p)=0 \tag{14}$$

has no solutions $p_j$ such that $Re(p_j)\geqq 0$. Smilen and Youla develop a necessary and sufficient criterion that a passive stabilizing termination exists. Defining Θ and F(Θ) via, $$\Theta = \left(\frac{R_j}{R_s} - 1\right)^{-\frac{1}{2}} \tag{15}$$

$$F(\Theta) = \frac{\Theta^3}{1+\Theta^2} \cdot \frac{1}{\Theta - \arctan(\Theta)} \tag{16}$$

the TD is potentially stable if $R_s < R_j$ and $$\frac{L_s}{R_j^2 \cdot C_j} < F(\Theta) \tag{17}$$

Satisfaction of the theorem does not guarantee that a bias network constrained to incorporate the bootstrap circuit and a particular matching network can be found which also stabilizes the TD. However, if the theorem is satisfied it is reasonable to try synthesizing such a circuit. The following analysis demonstrates that for nominal device parameters satisfying the theorem that stability to oscillation is realized for particular choices of device values.

Applying this theorem to the device in column 1 of the table illustrated in FIG. 5, biased such that $R_j = 1000\ \Omega$, then $f_{ro} = 1.97 \times 10^9$ Hz, $\Theta = 0.0141425$, $F(\Theta) = 2.99975$, and the inequality in equation 17 evaluates to $1.754 \times 10^{-4} = 2.99975$.

The theorem on potential stability gives the conditions for which a passive network exists to stabilize the TD. However, the bootstrap circuit 20 and matching network 52 must be treated as an active network, at least up to the frequency at which the Thévenin equivalent impedance becomes strictly positive ($10^5$ Hz). The theorem has predictive value if the poles of the junction driving point impedance are at frequencies above this transition from active to passive, which was the case for the regions of parameter space delimited below, with either an RC shunt or an RC-dc shunt in the matching network.

Having shown a particular device to be potentially stable, the components of the matching network 52 shown in FIG. 5 must be chosen. A particular choice of components is acceptable if it stabilizes a system function describing the voltage across the NNRD. Having biased the NNRD and matching with a monostable loadline at the design operating point ($V_{ref}$, $I_{ref}$), the device will experience voltage fluctuations across the terminals due to fluctuations in the current through the junction, as described in detail in the next section. For a δ function current spike through the junction, applied at node A of FIG. 4, the Laplace transform of the junction voltage (transformed to the complex p-plane) is $$\Delta V_j[p] = \frac{Z_{junction}}{Z_{total}} \tag{18}$$

$$= \frac{\dfrac{1}{C_j \cdot p - \dfrac{1}{R_j}}}{\dfrac{1}{C_j \cdot p - \dfrac{1}{R_j}} + R_s + L_s \cdot p + \dfrac{1}{\dfrac{1}{R_{sh2}} + \dfrac{1}{R_{sh1} + \dfrac{1}{C_{sh1} \cdot p}} + \dfrac{1}{R_{ser} + Z_{Thev}[p]}}} \tag{19}$$

where $Z_{total}$ is the total impedance in the loop driven by the current source driving the voltage fluctuation (the impedance of the junction plus the impedance seen across TD terminals due to the balance of the circuit). The requirement that the time-dependent perturbation $\Delta V_j[t]$ decay exponentially in time implies that the poles of $\Delta V_j[p]$ must be confined to the closed LHS of the p-plane. In the next paragraphs, the locations of these poles are examined for various matching network configurations, and for a range of component values within each configuration.

The stability of the exemplary device reference circuit will be investigated for the following cases:

(1) pure capacitive shunting of the TD (i.e., $R_{sh2} = \infty$, $R_{sh1} = 0$):
  (a) $0.0 \leqq R_{ser} \leqq 10.0\ \Omega$
  (b) $5.0 \times 10^{-12} \leqq C_{sh1} \leqq 1.0 \times 10^{-10}$ F (2) RC shunt (i.e., $R_{sh2} = \infty$, $R_{sh1} = 0$):
  (a) $R_{sh1} = 10.0\ \Omega$
  (b) $2.0 \leqq R_{ser} \leqq 10.0\ \Omega$
  (c) $1.0 \times 10^{-11} \leqq C_{sh1} \leqq 2.0 \times 10^{-10}$ F (3) Combined RC and dc shunt (i.e., $R_{sh2}$=finite, $R_{sh1} > 0$):
  (a) $R_{ser} = 2.0\ \Omega$
  (b) $1.0 \times 10^{-11} \leqq C_{sh1} \leqq 1.0 \times 10^{-10}$ F With respect to the use of a capacitive shunt, the denominator of $\Delta V_j[p]$, for the parameter set of column 1 of the table in FIG. 5 is $$9.97 \times 10^{62} - 5.31 \times 10^{50} p + 2.48 \times 10^{47} p^2 + 1.12 \times 10^{35} p^3 + 9.00 \times 10^{26} p^4 \tag{20}$$

The negative coefficient in the first order term implies that the stability criteria are violated, and that the poles are not confined to the LHS of the complex p-plane. The $C_{sh1}$ dependence of this quantity indicates that one strategy for stabilizing the circuit is to minimize the value of $C_{sh1}$:

$$9.97 \times 10^{62} + 6.88 \times 10^{52} p - 6.93 \times 10^{63} C_{sh1} + 9.00 \times 10^{46} p^2 + \ldots \tag{21}$$

The threshold conditions on $C_{sh1}$ and $R_{ser}$ for which a $\Delta V_j[p]$ is stable were found to be (approximately) $C_{sh1} \leqq 1.0 \times 10^{-11}$ F and $R_{ser}$ 10.0 Ω. To satisfy the global criterion of monostable loading of the tunnel diode, it is desirable to keep $R_{ser}$ as small as possible, hence the strategy of minimizing $C_{sh1}$.

With respect to the use of an RC shunt, the addition of a 10Ω resistor in series with $C_{sh1}$ improves the stability of the circuit dramatically, and alters the $C_{sh1}$ dependence of equation 20 as follows:

$$9.97 \times 10^{62} + 6.88 \times 10^{52} p + 3.041 \times 10^{63} C_{sh1} p + \ldots \tag{22}$$

so that stability is achieved for large values of the shunt capacitor. The poles of $V_{ref}$ were found, and were confined to the LHS of the p-plane for all cases shown in FIG. 5.

With respect to the use of RC and dc shunting, the addition of the dc shunt shifts the poles slightly, as the values for the feedback $R_{sh2}$. However, in all cases shown in FIG. 5 the poles are well away from the RHS of the complex p-plane. The flexibility to choose the operating point independently of the dynamic resistance of the NNRD implies a significant advantage versus avalanche diode based voltage references.

In the section that follows herein, the output noise of a TD bootstrap voltage reference is estimated, and compared with NIST guidelines for solid-state transfer standard performance. Each non-reactive circuit element contributes noise with a characteristic spectral density to the total output noise of the reference. The noise can be categorized as arising from three primary sources: (1) the current and voltage noise components associated with the op-amp, represented by input referenced noise generators; (2) fluctuations in the separate current components flowing through the tunnel junction; and (3) fluctuations in the noise power dissipated in the resistors in the feedback loops or matching network.

The primary contribution to noise in the reference voltage comes from fluctuations in the current through the tunnel junction. Random fluctuations occur in each of three distinct charge carrier transport mechanisms: tunneling of electrons from the n-side conduction band to the p-side valence band (the so-called band-to-band tunneling, mediated (perhaps) by phonons but not involving intermediate energy levels, defect or impurity mediated tunneling (the excess current), and thermal diffusion current. Only the band-band and excess currents contribute significantly to the noise when the TD is biased at voltages close to $V_{peak}$. The noise characteristics of these currents are discussed below.

With respect to band-band current noise, the tunneling of electrons form the n-side conduction band to hole states on the p-side is to first order a Poisson process in which electrons traverse the energy barrier uncorrelated with the passage of other electrons. The tunneling process may be mediated by phonon interactions in indirect semiconductors (Si), unmediated for direct materials [GaAs], or a mixture of each. The noise current spectral density $S_{ns}^{b-b}$ of the band-band current for the case that tunneling is not phonon-mediated is found to be:

$$\overline{(S_{ns}^{b-b2})} = 2 \cdot q \cdot I_{b-b} \cdot \coth\left[\frac{qV_j}{2kT}\right] \tag{23}$$

which, for the values of $V_j$ close to $V_{peak}$, is essentially the shot noise relation.

With regard now to excess current noise, excess current can be defined as the current obtained at bias voltages such that the bands are uncrossed, but which are still below the voltage at which appreciable diffusion current flows, or that component of the tunnel current which is mediated by a population of defect/impurity associated energy levels within the forbidden gap.

The first definition describes a quantity which can be easily measured. Near the valley point, the current (composed primarily of current satisfying the first definition above) has a logarithmic dependence on the junction voltage, which can be extrapolated back to find the defect-mediated excess current for $V_{bias} \approx V_{peak}$. However, this extrapolation is not accurate for either the intrinsic or extrinsic excess current, and so that the more general second definition must be used in determining $I_x$ in the region of the current peak. It is necessary to distinguish the separate components of the excess current based upon the type or origin of the energy states which mediate transport across the junction. The components are: (1) impurity states associated with degenerate doping of the diode (the so-called band-tail); (2) energy states associated with deep level impurities; (3) states associated with processing-induced defects (grain boundaries, dislocations, incomplete development of the terminal planes); (4) states due to mechanical deformation of the junction; (5) states associated with radiation-induced defect (electron or neutron irradiation); and (6) states due to electrical stress on the diode. States of types (1)–(3) mediate the intrinsic, or as-fabricated, excess current, while states of types (4)–(6) mediate the extrinsic excess current.

In principle, each type of excess current defined above (mechanisms 1–6) will contribute noise with a distinct noise current spectral density. Summing the mean square current noise due to each mechanism yields $$\overline{(S_{ns}^{excess2})}_{tot} = \Sigma_j \overline{(S_{ns}^{excess})_j^2} \tag{24}$$

Whereas the noise signature of the band-band current is that of pure shot noise, the noise signature of the excess current has been shown to have a 1/f dependence. An estimate of the excess noise in the absence of extrinsic excess current will be:

$$\overline{S_{ns}^{excess2}} \simeq \frac{C_1}{f} \times (I_{excess})^2 \tag{25}$$

$$\simeq \frac{C_1}{f} \times (I_{b-b} \times C_2)^2 \tag{26}$$

where Log [$C_1$] is the y intercept found from a plot of $$\mathrm{Log}[\overline{S_{ns}^{excess2}}] \tag{27}$$

versus $I_{excess}$, and $C_2$ is defined as $$C_2 = \left(\frac{I_{exess}}{I_{b-b}}\right)_{V_{bias}=V_{op}} \tag{28}$$

At frequencies below $10^4$ Hz, the reactive elements in the matching network can be ignored, leading to the following low frequency approximation to the noise current spectral density of the reference voltage:

$$S_{ns}^{ref} = \left(\frac{R2+R3}{R3}\right)\cdot\left(\frac{R1}{R_{ser}+R1}\right)\left(\frac{1}{\left(1-\frac{R_s}{R_j}\right)\left(\frac{1}{R_{ser}+R1}+\frac{1}{R_{sh2}}\right)-\frac{1}{R_j}}\right)\cdot\sqrt{S_{ns}^{excess2}+S_{ns}^{b-b2}} \tag{29}$$

From equation 24, at $I_{b-b} \approx I_{peak} = 0.01$ mA and $V_j = 70$ mV, $\overline{S_{ns}^{b-b2}} = 3.537 \times 10^{-21}$ [$A^2$/Hz]. At 1 kHz and for the same value of $V_j$, $\overline{S_{ns}^{excess2}}$ is found (using equations (25) to (28) to be $3.56 \times 10^{-21}$ [$A^2$/Hz]. While these two quantities are of similar magnitude at 1 kHz, the 1/f dependence of $\overline{S_{ns}^{excess2}}$ implies that the excess noise will dominate at lower frequencies, and that the integrated noise current in the frequency range of interest will consist primarily of noise due to excess current.

The performance guidelines presented above pertain to rms noise in a frequency band from 0.01 Hz to 10 Hz. To calculate the rms noise voltage at the output, equation 25 is integrated over the frequency range of interest, the square root is taken to obtain the rms noise current through the diode in the frequency range ($f_l$, $f_h$), and the result used with equation 29:

$$V_{ns}^{ref} = \left(\frac{R2 + R3}{R3}\right)\left(\frac{R1}{R_{ser} + R1}\right) \cdot \left(\frac{1}{\left(1 - \frac{R_s}{R_j}\right)\left(\frac{1}{R_{ser} + R1} + \frac{1}{R_{sh2}}\right) - \frac{1}{R_j}}\right) \cdot \sqrt{\int_{fl}^{fh} \overline{(S_{ns}^{excess2})}\, df} \tag{30}$$

with the integral under the square root defined by $$\int_{fl}^{fh} \overline{(S_{ns}^{excess2})}\, df = C_1 \cdot (I_{b-b} \cdot C_2)^2 \times \log\left[\frac{fh}{fl}\right] \tag{31}$$

Using the values of $C_1$ and $C_2$ estimated above, the rms voltage noise at the output due to the tunnel diode in the band (0.01 Hz, 10 Hz) is found to be $4.96 \times 10^{-6}$ $V_{rms}$ (0.496 ppm of the 10 volt output). If the integration is carried out over the band (0.00001 Hz, 10 Hz), then $V_{refns} = 7.02 \times 10^{-6}$ $V_{rms}$ (0.702 ppm of the 10 volt output). Any variances from the NIST guidelines may be overcome by improving the upper bound estimates of low-frequency noise in the TDs through fabrication techniques to optimize components for voltage reference circuits.

I claim:

1. A bootstrap voltage reference circuit comprising:

an amplifying comparator device having first and second inputs and an output, said amplifying comparator device operable for generating a predetermined reference voltage as the difference between a first signal applied to said first input and a second signal applied to said second input approaches zero;

a first feedback network coupled between said output and said first input of said amplifying comparator device, said first feedback network including a non-linear device which operates as a current source at an operating point in the region of a local maximum in its current-voltage characteristic curve, said non-linear device comprising an n-type negative resistance device, said first feedback network generating said first signal applied to said first input; and a second feedback network coupled between said output and said second input of said amplifying comparator device, said second feedback network generating said second signal applied to said second input.

2. The circuit of claim 1, wherein said predetermined voltage is generated at said output.

3. The circuit of claim 1, wherein said predetermined voltage is generated at said first input.

4. The circuit of claim 1, wherein said amplifying comparator device comprises an operational amplifier.

5. The circuit of claim 4, wherein said first and second inputs correspond to a positive input and a negative input, respectively, associated with said operational amplifier.

6. The circuit of claim 1, wherein said non-linear device associated with said first feedback network operates as a current source in accordance with the equation $dI/dV=0$ over at least one point on a current-voltage characteristic curve associated with said non-linear device where said at least one point does not occur at V substantially equal to zero.

7. The circuit of claim 1, wherein said n-type negative resistance device comprises a tunnel diode.

8. The circuit of claim 1, wherein said n-type negative resistance device comprises a resonant tunnel diode.

9. The circuit of claim 1, wherein said non-linear device comprises a back diode.

10. The circuit of claim 1, wherein said second feedback network comprises a device which operates as a voltage source over at least one point on a current-voltage characteristic curve associated with said device where said at least one point does not occur at V equal to zero.

11. The circuit of claim 10, wherein said device comprises a second non-linear device.

12. The circuit of claim 11, wherein said second non-linear device comprises an avalanche diode.

13. The circuit of claim 11, wherein said second non-linear device comprises an s-type negative resistance device.

14. The circuit of claim 13, wherein said s-type negative resistance device comprises a metal-insulated-semiconductor (MIS) switch diode.

15. The circuit of claim 10, wherein said device comprises a linear device.

16. The circuit of claim 15, wherein said linear device comprises at least one resistor.

17. The circuit of claim 1 further comprising a matching network coupled to said non-linear device of said first feedback network.

18. The circuit of claim 17, wherein said matching network comprises a two-port network coupled between said non-linear device, and said first input and said output.

19. The circuit of claim 17, wherein said matching network comprises a linear time invariant network.

20. The circuit of claim 19, wherein said matching network comprises at least one resistive shunt and at least one capacitive shunt.

21. The circuit of claim 19, wherein said matching network comprises a series resistor-capacitor shunt.

22. A bootstrap voltage reference circuit comprising:

an operational amplifier having positive and negative inputs and an output, said amplifier operable for generating a predetermined reference voltage as the difference between a first signal applied to said positive input and a second signal applied to said negative input approaches zero;

a positive feedback network coupled between said output and said positive input of said amplifier, said positive feedback network including a non-linear device which operates as a current source at an operating point in the region of a local maximum in its current-voltage characteristic curve, said non-linear device comprising an n-type negative resistance device, said positive feedback network generating said first signal applied to said positive input; and a negative feedback network coupled between said output and said negative input of said amplifier, said negative feedback network generating said second signal applied to said negative input.

23. The circuit of claim 22, wherein said predetermined voltage is generated at said output.

24. The circuit of claim 22, wherein said predetermined voltage is generated at said first input.

25. The circuit of claim 22, wherein said non-linear device associated with said positive feedback network operates as a current source in accordance with the equation $dI/dV=0$ over at least one point on a current-voltage characteristic curve associated with said non-linear device where said at least one point does not occur at V substantially equal to zero.

26. The circuit of claim 22, wherein said n-type negative resistance device comprises a tunnel diode.

27. The circuit of claim 23, wherein said n-type negative resistance device comprises a resonant tunnel diode.

28. The circuit of claim 22, wherein said non-linear device comprises a back diode.

29. The circuit of claim 22, wherein said negative feedback network comprises a device which operates as a voltage source over at least one point on a current-voltage characteristic curve associated with said device where said at least one point does not occur at V substantially equal to zero.

30. The circuit of claim 29, wherein said device comprises a second non-linear device.

31. The circuit of claim 30, wherein said second non-linear device comprises an avalanche diode.

32. The circuit of claim 30, wherein said second non-linear device comprises an s-type negative resistance device.

33. The circuit of claim 32, wherein said s-type negative resistance device comprises a metal-insulated-semiconductor (MIS) switch diode.

34. The circuit of claim 29, wherein said device comprises a linear device.

35. The circuit of claim 34, wherein said linear device comprises at least one resistor.

36. The circuit of claim 22 further comprising a matching network coupled to said non-linear device of said positive feedback network.

37. The circuit of claim 36, wherein said matching network comprises a two-port network coupled between said non-linear device, and said positive input and said output.

38. The circuit of claim 36, wherein said matching network comprises a linear time invariant network.

39. The circuit of claim 38, wherein said matching network comprises at least one resistive shunt and at least one capacitive shunt.

40. The circuit of claim 38, wherein said matching network comprises a series resistor-capacitor shunt.

* * * * *